US005758945A

United States Patent [19]

Lima

[11] Patent Number: 5,758,945

[45] Date of Patent: Jun. 2, 1998

[54] DEVICE FOR ENHANCING THE BRILLIANCY OF JEWELRY

[76] Inventor: Alejandro E. Lima, 4807 W. Flagler St., Miami, Fla. 33134

[21] Appl. No.: 879,595

[22] Filed: Jun. 20, 1997

Related U.S. Application Data

[63] Continuation-in-part of Ser. No. 763,576, Dec. 10, 1996, Pat. No. 5,669,240.

[51] Int. Cl.[6] ..... F21L 15/08

[52] U.S. Cl. ..... 362/84; 362/104; 63/15; 63/31

[58] Field of Search ..... 362/84, 104, 806; 63/2, 15, 26, 29.1, 30, 32

[56] References Cited

U.S. PATENT DOCUMENTS

| | | | |
|---|---|---|---|
| 4,187,697 | 2/1980 | Castelo | 63/31 |
| 4,294,084 | 10/1981 | Lampert | 63/15 |
| 4,796,442 | 1/1989 | Sarcona | 63/31 |
| 4,977,757 | 12/1990 | Mesica et al. . | |
| 5,323,300 | 6/1994 | McCrary | 362/104 |
| 5,519,591 | 5/1996 | McCrary | 362/104 |
| 5,690,412 | 11/1997 | Sheldon | 362/104 |

FOREIGN PATENT DOCUMENTS 363137 of 1920 Germany .

*Primary Examiner*—Thomas M. Sember
*Attorney, Agent, or Firm*—J. Sanchelima

[57] ABSTRACT

A device for enhancing the brilliancy of transparent or translucent stones used in jewelry pieces. A tract assembly with one or more channels is mounted in a conspicuous position of a jewelry piece. One or more carriers holding the stones in a through opening are slidably mounted within the channels. A phosphorescent plate or deposit on the bottom surface of the channel directs visible light to the exposed surface of the moving stones causing refractions with different characteristics as the angle of incidence varies constantly resulting in enhanced brilliancy of the jewelry piece. Plug members are removably mounted to the ends of the channels preventing the carriers from falling off.

6 Claims, 2 Drawing Sheets

DEVICE FOR ENHANCING THE BRILLIANCY OF JEWELRY

OTHER RELATED APPLICATIONS

The present application is a continuation-in-part of allowed U.S. patent application No. 08/763,576, filed on Dec. 10, 1996, now U.S. Pat. No. 5,669,240 which is hereby incorporated by reference.

BACKGROUND OF THE INVENTION

1. Field of the Invention

The present invention relates to a device for enhancing brilliance of stones in jewelry pieces, and more particularly, to a device that through moving parts and a phosphorescent source of light enhances the brilliance and reflective characteristics of precious stones.

2. Description of the Related Art

The prior art includes moving devices like U.S. Pat. No. 4,977,757 issued to Mesica in 1990 entitled "Jewelry with Rotatable Ornamentation" and German patent No. 363,137 issued in 1920. However, none of them disclose the use of slidable carriers holding a precious stone whose brilliance is enforced with a luminous source.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a device that has movable precious stone carrier members for enhancing the brightness and glamour of the stones.

It is another object of this invention to provide a device that includes a phosphorescent element mounted below the movable stone carrier members providing illumination to the stones for subsequent reflection.

It is still another object of the present invention to provide a device that can be readily cleaned and repaired, when needed, with minimum effort.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
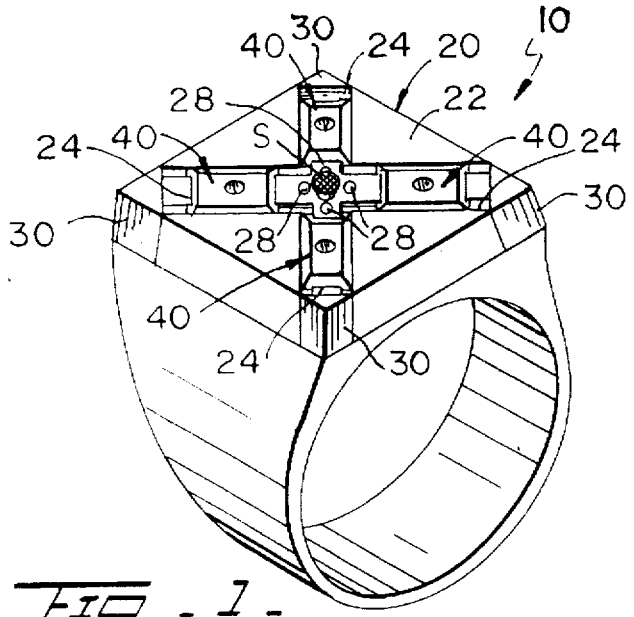
FIG. 1 is an isometric view from the top of one of the preferred embodiments for the present invention used in a ring.

Referring now to the drawings, where the present invention is generally referred to with numeral 10, it can be observed that it basically includes jewelry track assembly 20 with sliding stone carriers 40 that are slidably mounted thereon and cooperatively adapted to support precious stones S of the transparent or translucent types. In the drawings, a ring application is represented but any other jewelry piece is also suitable, such as cufflings, pendants, etc. The present invention is provided with phosphorescent member 70 for a source of visible light that reaches the stone(s) S mounted on carrier(s) 40.

Figure 2:
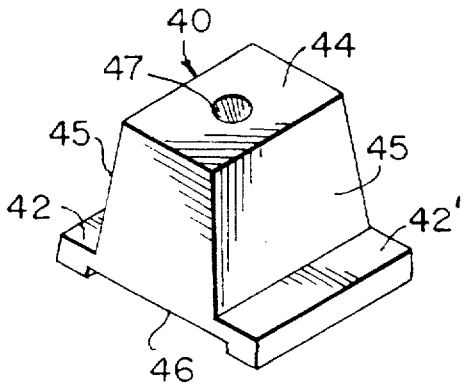
FIG. 2 is an isometric view of a stone carrier member used with the preferred embodiment shown in FIG. 1.

Jewelry track assembly 20 basically includes block member 22 with channels 24 defining a path for sliding stone carriers 40 to travel along. As seen in FIG. 2, on way of keeping sliding stone carrier 40 within channel 24 includes guiding flange members 42 and 42' located at its lowermost portion. Guiding members 42 and 42' permit carrier 40 to slide inside slots 24' at the bottom of channel 24 of jewelry track assembly 20 without falling. Sliding stone carrier member 40 also includes slanted walls 45 upper wall 44 and lower wall 46. The inclination of slanted wall 45 as seen in FIG. 2, is intended to keep carrier 40 from falling and some clearance is allowed to facilitate the sliding function. Carrier 40 includes through hole 47 for receiving a precious stone of the transparent or translucent type. Lower wall 46 has a recess inwardly extended and is designed to permit carrier 40 to travel without interference with phosphorescent member 70, which may be a plate or film deposit.

Phosphorescent member 70 is positioned on wall 27 of block member 22 and its purpose is to provide a luminous source that is more noticeable during low light conditions. The phosphorescent light coming from phosphorescent member 70 and the free displacement of sliding stone carrier members 40 cause the random reflection and refraction of the light reaching the precious stones mounted on carriers 40.

Figure 3:
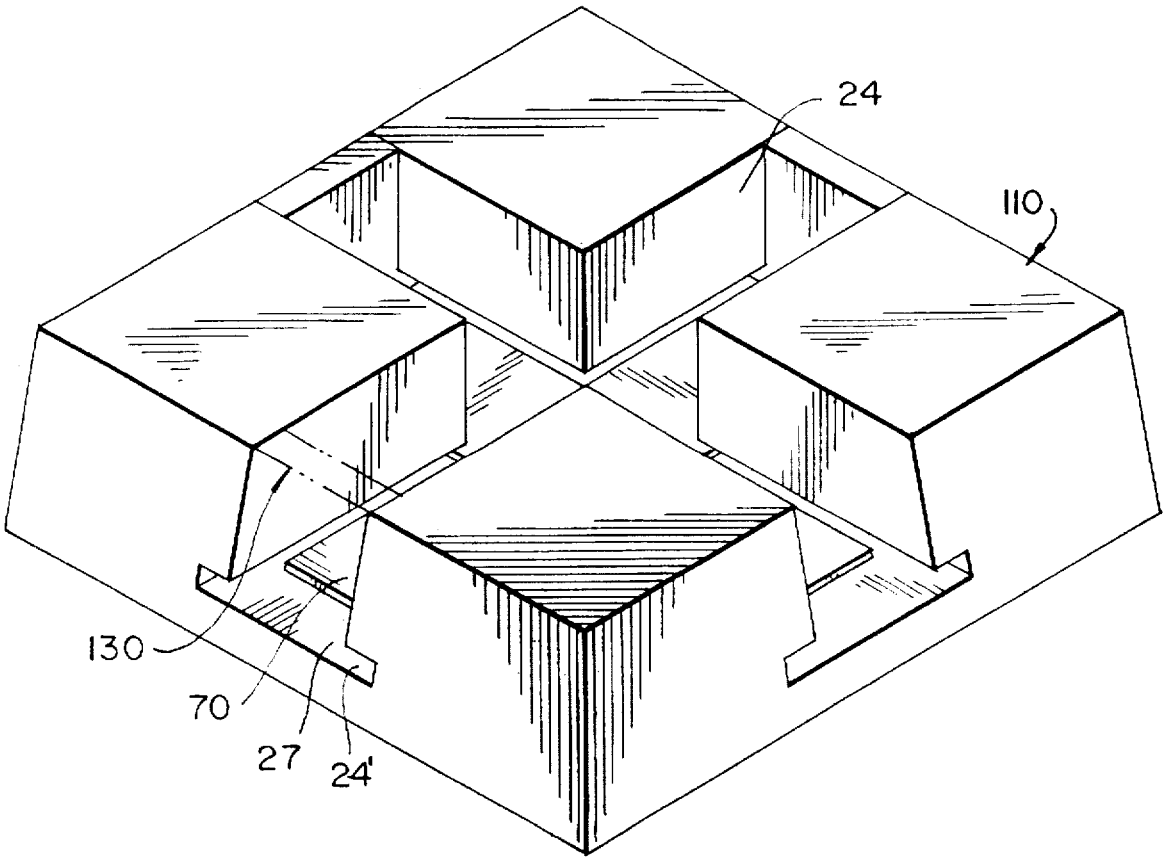
FIG. 3 is a partial isometric view from the top of a jewelry track assembly.
Figure 6:
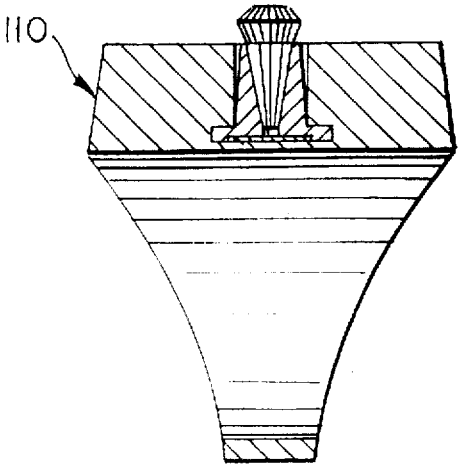
FIG. 6 is a cross-sectional view of the ring assembly shown in FIG. 3.
Figure 4:
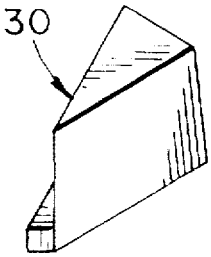
FIG. 4 is an isometric view of a plug member.
Figure 5:
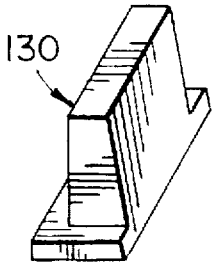
FIG. 5 is an isometric view of another variety of the plug member.

The displacement of sliding stone carrier members 40 is limited by plug members 30 at the outer ends of channels 24 and by central stopper member 28, at the inner ends of channel 24. As shown in FIG. 1, a precious stone S may be rigidly mounted in the middle portion of stopper member 28. Plug members 30 close or plug the distal ends of channels 24 to prevent carriers 40 from leaving the track. In FIG. 4, plug member 30 has a triangular configuration to be able to fit in the corner of block member 22 of device 10 as shown in FIG. 1. In FIG. 5, plug member 130 has a rectangular configuration to be able to fit in the distal ends of channels 124 of device 110 shown in FIG. 3.

Figure 7:
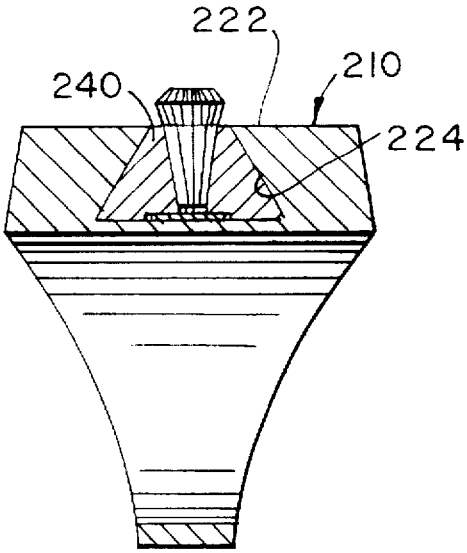
FIG. 7 is a cross-sectional view of another variety of the ring assembly.
Figure 8:
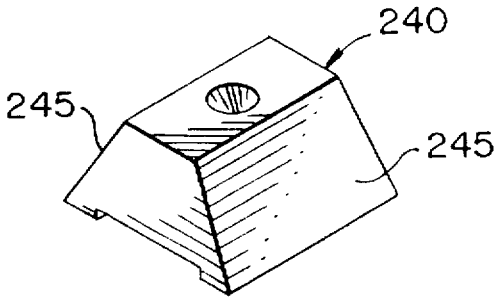
FIG. 8 is an isometric view of an alternative of the stone carrier member.

As shown in FIGS. 7 and 8, an alternate embodiment is generally referred to with numeral 210 with carrier 240. Sliding stone carrier member 240 has the same function like above described carrier 40. Sliding stone carrier member 240 does not need guiding members 42 and 42' as carrier 40 does because of its pronounced slanted walls 245 that do not allow carrier 240 to leave channels 224 of block member 222.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A device for enhancing the brilliancy of transparent or translucent stones used in a jewelry piece, comprising:

A) a track assembly mounted to said jewelry piece and including at least one channel with a substantially flat bottom surface;

B) phosphorescent means for producing visible light mounted on said bottom surface; and C) carrier means slidably mounted within said channel and over said phosphorescent luminous means and further including a through opening for cooperatively receiving at least one of said stones so that said light is applied to said stone or stones thereby enhancing its or their brilliance through refraction of the light from different angles of light incidence as said carrier means move.

2. The device set forth in claim 1 wherein said carrier means includes:

D) guiding means for preventing said carrier means from leaving said channel.

3. The device set forth in claim 2 wherein said carrier means includes a recess to avoid contact with said phosphorescent means.

4. The device set forth in claim 3 wherein said channel has two ends and one of said ends extends to the edge of said track assembly and said device further includes removable plug means for preventing said carrier means from leaving said channel.

5. The device set forth in claim 4 wherein said guiding means includes at least one slanted wall in said carrier means with a corresponding cooperating slanted wall in said channel so that said carrier means cannot leave said channel.

6. The device set forth in claim 5 wherein said channels include slots longitudinally and coextensive with said channels and said carrier means include each cooperating guiding means slidably receivable within said slots.

* * * * *